US010252428B2

(12) United States Patent
Ranieri et al.

(10) Patent No.: US 10,252,428 B2
(45) Date of Patent: Apr. 9, 2019

(54) UTILITY KNIFE WITH SKEWED PIVOTAL BLADE LOCK

(71) Applicant: STANLEY BLACK & DECKER, INC., New Britain, CT (US)

(72) Inventors: Eric Ranieri, Pouilley-les-Vignes (FR); Stephen Rowlay, Derbyshire (GB); Thomas Pelletier, Wallingford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 50 days.

(21) Appl. No.: 15/343,165

(22) Filed: Nov. 3, 2016

(65) Prior Publication Data

US 2017/0129112 A1 May 11, 2017

Related U.S. Application Data

(60) Provisional application No. 62/251,236, filed on Nov. 5, 2015.

(51) Int. Cl.
*B26B 5/00* (2006.01)
*B26B 1/08* (2006.01)

(52) U.S. Cl.
CPC ..... *B26B 5/001* (2013.01); *B26B 1/08* (2013.01); *B26B 5/003* (2013.01)

(58) Field of Classification Search
CPC ..... B26B 5/001; B26B 5/003; B26B 1/08
USPC ..... 30/162
See application file for complete search history.

(56) References Cited

U.S. PATENT DOCUMENTS

| | | | | |
|---|---|---|---|---|
| 4,242,795 | A | 1/1981 | Rollband et al. | |
| 6,249,975 | B1 | 6/2001 | Lin | |
| 6,357,120 | B1 * | 3/2002 | Khachatoorian | B26B 5/001 30/162 |
| 6,374,497 | B1 * | 4/2002 | Sun | B26B 5/001 30/125 |
| 7,107,688 | B1 | 9/2006 | Critelli et al. | |
| 7,930,829 | B2 | 4/2011 | Ranieri et al. | |
| 2005/0055833 | A1 * | 3/2005 | Scarla | B26B 1/02 30/156 |
| 2005/0188541 | A1 * | 9/2005 | Brown | B26B 5/001 30/162 |
| 2010/0223793 | A1 | 9/2010 | Hansen et al. | |

(Continued)

FOREIGN PATENT DOCUMENTS

EP 3 165 337 A1 * 5/2017

*Primary Examiner* — Hwei-Siu C Payer
(74) *Attorney, Agent, or Firm* — Pillsbury Winthrop Shaw Pittman LLP

(57) ABSTRACT

A utility knife includes a blade holder slidably connected to the handle. A blade lock pivotally connects to the blade holder for movement relative to the blade holder about a blade lock axis between a locked position and a released position. The blade lock axis forms an acute angle α with a lateral direction of the knife so that a surface of the blade lock that is configured to engage the utility blade moves both laterally and vertically as the blade lock moves between its locked and released positions. A blade release trigger is conveniently disposed well rearwardly of a front of the handle. The knife includes a sealed blade storage compartment with a manually openable cover. A seal disposed between the compartment and cover discourages water and/or debris from getting into the compartment when the cover is closed.

22 Claims, 10 Drawing Sheets

(56) References Cited

U.S. PATENT DOCUMENTS

| | | | | |
|---|---|---|---|---|
| 2011/0023308 | A1* | 2/2011 | Ping | B26B 1/042 30/161 |
| 2012/0260505 | A1* | 10/2012 | Qiu | B26B 1/042 30/165 |
| 2017/0129112 | A1* | 5/2017 | Ranieri | B26B 5/001 |

* cited by examiner

UTILITY KNIFE WITH SKEWED PIVOTAL BLADE LOCK

CROSS REFERENCE

This application claims the benefit of priority from U.S. Provisional Patent Application Ser. No. 62/251,236, filed Nov. 5, 2015, titled "UTILITY KNIFE WITH SKEWED PIVOTAL BLADE LOCK," the entire contents of which are hereby incorporated by reference herein.

BACKGROUND OF THE INVENTION

1. Field of the Invention

This invention relates to utility knives that can selectively expose or protect a cutting edge of a replaceable utility blade.

2. Description of Related Art

A conventional utility knife includes a handle with a blade holder slidably disposed within the handle. See, e.g., U.S. Pat. Nos. 4,242,795, 6,249,975. A utility blade detachably mounts to the blade holder. The standard blade has a cutting edge disposed on one edge and one or more mounting notches disposed on an opposite edge. When the blade holder is in a retracted position, the blade is disposed within and protected by the handle. When the blade holder is slid into an extended position, a portion of the blade becomes exposed for use.

SUMMARY OF EMBODIMENTS OF THE INVENTION

One of more embodiments of the present invention provides a knife that includes: a handle; a blade holder connected to the handle and configured to receive a utility blade; and a blade lock pivotally connected to the blade holder for movement relative to the blade holder about a blade lock axis between a locked position and a released position. When the blade lock is in the locked position, a lock surface of the blade lock is configured to engage the utility blade to lock the blade to the blade holder. When the blade lock is in the released position, the lock surface is configured to permit the utility blade to be inserted into and removed from the blade holder. The blade lock axis forms an angle $\alpha$ relative to a lateral direction of the knife. According to various embodiments, The angle $\alpha$ is (1) greater than 3, 4, 5, 6, 7, 8, 9, 10, 12.5, 15, 17.5, 20, 22.5, 25, 27.5, and/or 30 degrees, (2) less than 87, 85, 80, 75, 70, 65, 60, 55, 50, 45, 40, and/or 35 degrees, and/or (3) within any range between any two such values (e.g., between 3 and 87 degrees, between 5 and 85 degrees, between 10 and 60 degrees, between 15 and 50 degrees, between 20 and 40 degrees, and/or about 30 degrees).

According to one or more embodiments, the knife includes a spring that spring-biases the blade lock toward its locked position.

According to one or more embodiments, the knife includes a manually actuatable blade lock release that is movably connected to the handle for movement between an unactuated position and an actuated position, and a blade lock release spring that spring-biases the blade lock release toward its unactuated position. The blade lock release is configured to be positioned relative to the blade lock such that movement of the blade lock release from its unactuated position to its actuated position forces the blade lock to move into the blade lock's released position. The release includes a manually accessible trigger portion that may be manually actuated by a user to move the release from the unactuated position into the actuated position.

According to one or more embodiments, the blade lock release includes a lever that is pivotally connected to the handle for pivotal movement about a release axis relative to the handle between the unactuated and actuated positions.

According to one or more embodiments, the release axis extends purely in the lateral direction such that the angle $\alpha$ is formed between the release axis and the blade lock axis.

According to one or more embodiments, a rearwardmost point of the trigger is disposed rearwardly of a forwardmost point on the handle by a distance h. The distance h is at least 1.8 inches.

According to one or more embodiments, the blade holder is movably carried by the handle for movement relative to the handle between a retracted position and an extended position. When the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively. When the blade holder is in the extended position, movement of the blade lock release from its unactuated position to its actuated position forces the blade lock to move into the blade lock's released position. When the blade holder is in the retracted position, movement of the blade lock release from its unactuated position to its actuated position does not force the blade lock to move into the blade lock's released position.

According to one or more embodiments, the blade holder is slidingly carried by the handle for sliding movement relative to the handle between a retracted position and an extended position. When the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively.

According to one or more embodiments, the knife includes a manually operable slide lock that releasably locks the blade holder in the extended position or the retracted position.

According to one or more embodiments, the lock surface moves in the lateral direction of the knife as the blade lock moves from its locked position to its released position.

According to one or more embodiments, the lock surface moves in the lateral direction of the knife and in an upward direction of the knife as the blade lock moves from its locked position to its released position.

According to one or more embodiments, the knife includes: a blade storage compartment having an opening through which the compartment may be accessed; a cover connected to the compartment for relative movement between open and closed positions; a seal disposed on one of the compartment and cover; and a manually releasable cover lock that releasably locks the cover in the closed position. When the cover is in the closed position, the seal is sandwiched between the cover and the compartment so as to seal the opening such that the compartment is a sealed compartment.

According to one or more embodiments, the handle includes a neck and a handle base, the neck connects to the handle base for movement relative to the handle base between a closed position and an open position, and the blade holder is slidingly carried by the neck.

According to one or more embodiments, the knife includes a manually releasable neck lock that releasably locks the neck in the closed position. The neck lock is configured such that manually releasing the neck lock while the neck is in the closed position permits the neck to be moved into the neck's open position.

According to one or more embodiments, the neck pivotally connects to the handle base for pivotal movement relative to the handle base between the closed position and the open position.

According to one or more embodiments, the knife includes the utility blade, and the utility blade is received by the blade holder.

According to one or more embodiments, the utility blade has a mounting notch formed in a first linear edge and a cutting edge opposite the first linear edge, and the utility blade substantially has the shape of an isosceles trapezoid, the cutting edge being disposed on a longest edge of the trapezoid.

According to one or more embodiments, the lateral direction is a direction that is perpendicular to a plane that includes both the first linear edge and the cutting edge.

According to one or more embodiments, the blade includes a planar side surface that is perpendicular to the lateral direction.

According to one or more embodiments, the blade holder has a side surface that is configured to abut a planar side surface of the utility blade. The side surface of the blade holder is perpendicular to the lateral direction.

One or more embodiments provides a knife that includes: a handle; a blade holder connected to the handle and configured to receive a utility blade; a blade lock movably connected to the blade holder for movement relative to the blade holder between a locked position and a released position; and a manually actuatable blade lock release that is movably connected to the handle for movement between an unactuated position and an actuated position. When the blade lock is in the locked position, a lock surface of the blade lock is configured to engage the utility blade to lock the blade to the blade holder. When the blade lock is in the released position, the lock surface is configured to permit the utility blade to be inserted into and removed from the blade holder. The blade lock release is configured to be positioned relative to the blade lock such that movement of the blade lock release from its unactuated position to its actuated position forces the blade lock to move into the blade lock's released position. The blade lock release includes a manually accessible trigger portion that may be manually actuated by a user to move the release from the unactuated position into the actuated position. A rearwardmost point of the trigger portion is disposed rearwardly of a forwardmost point on the handle by a distance h. According to various embodiments, the distance h is (a) at least 1.8, 1.9, 2.0, 2.1, 2.2, 2.3, 2.4, 2.5, 2.6, 2.7, and/or 2.8 inches, (b) less than 4.8, 4.3, 3.8, 3.7, 3.6, 3.5, 3.4, 3.3, 3.2, 3.1, and/or 3.0 inches, and/or (c) within any range between any two such values (e.g., between 1.8 and 4.8 inches, between 2.3 and 3.8 inches, between 2.5 and 3.5 inches, and/or about 2.9 inches).

According to one or more embodiments, the blade lock release includes a lever that is pivotally connected to the handle for pivotal movement between the actuated and unactuated positions. The knife further includes a spring that spring biases the blade lock release toward its unactuated position.

According to one or more embodiments, the knife includes the utility blade, and the utility blade is locked to the blade holder by the blade lock. According to various embodiments, a rearwardmost point of the utility blade is disposed forwardly of the rearwardmost point on the trigger by a distance b. According to various embodiments, the distance b is at least 0.8 inches and less than 4.2 inches.

One or more embodiments provides a knife that includes: a handle; a blade holder connected to the handle and configured to receive a utility blade; a blade storage compartment having an opening through which the compartment may be accessed; a cover movably connected to the compartment for movement relative to the compartment between open and closed positions; a seal disposed on one or both of the compartment and cover; and a manually releasable cover lock that releasably locks the cover in the closed position. When the cover is in the closed position, the seal is sandwiched between the cover and the compartment so as to seal the opening such that the compartment is a sealed compartment.

These and other aspects of various embodiments of the present invention, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

For a better understanding of embodiments of the present invention as well as other objects and further features thereof, reference is made to the following description which is to be used in conjunction with the accompanying drawings, where.

DETAILED DESCRIPTION OF EXEMPLARY EMBODIMENTS OF THE INVENTION

Figure 1:
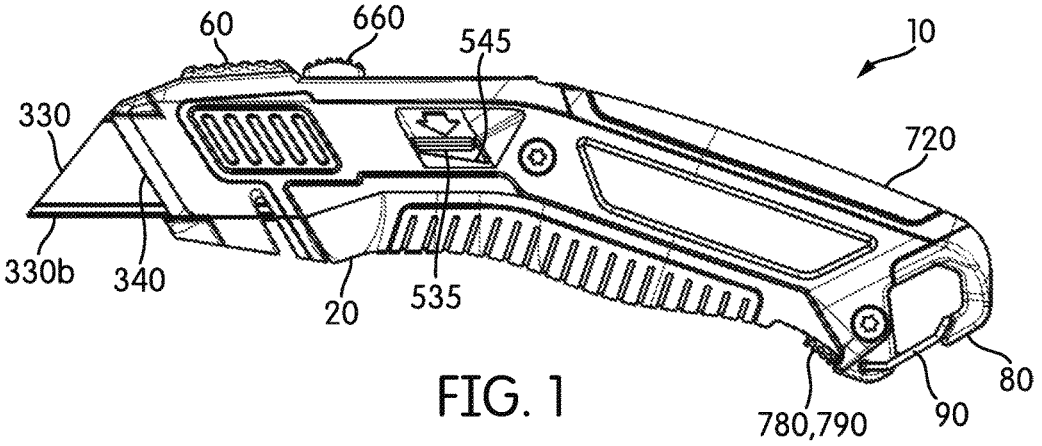
FIG. 1 is a left side view of a knife according to an embodiment, shown with the blade holder extended and blade exposed.

FIGS. 1-9 illustrate a utility knife 10 according to an embodiment of the present invention. The knife 10 includes a handle 20, a sliding blade holder 300, a blade lock 400, a manually actuatable blade lock release 500, a slide lock 600, and a storage compartment 700.

Figure 9:
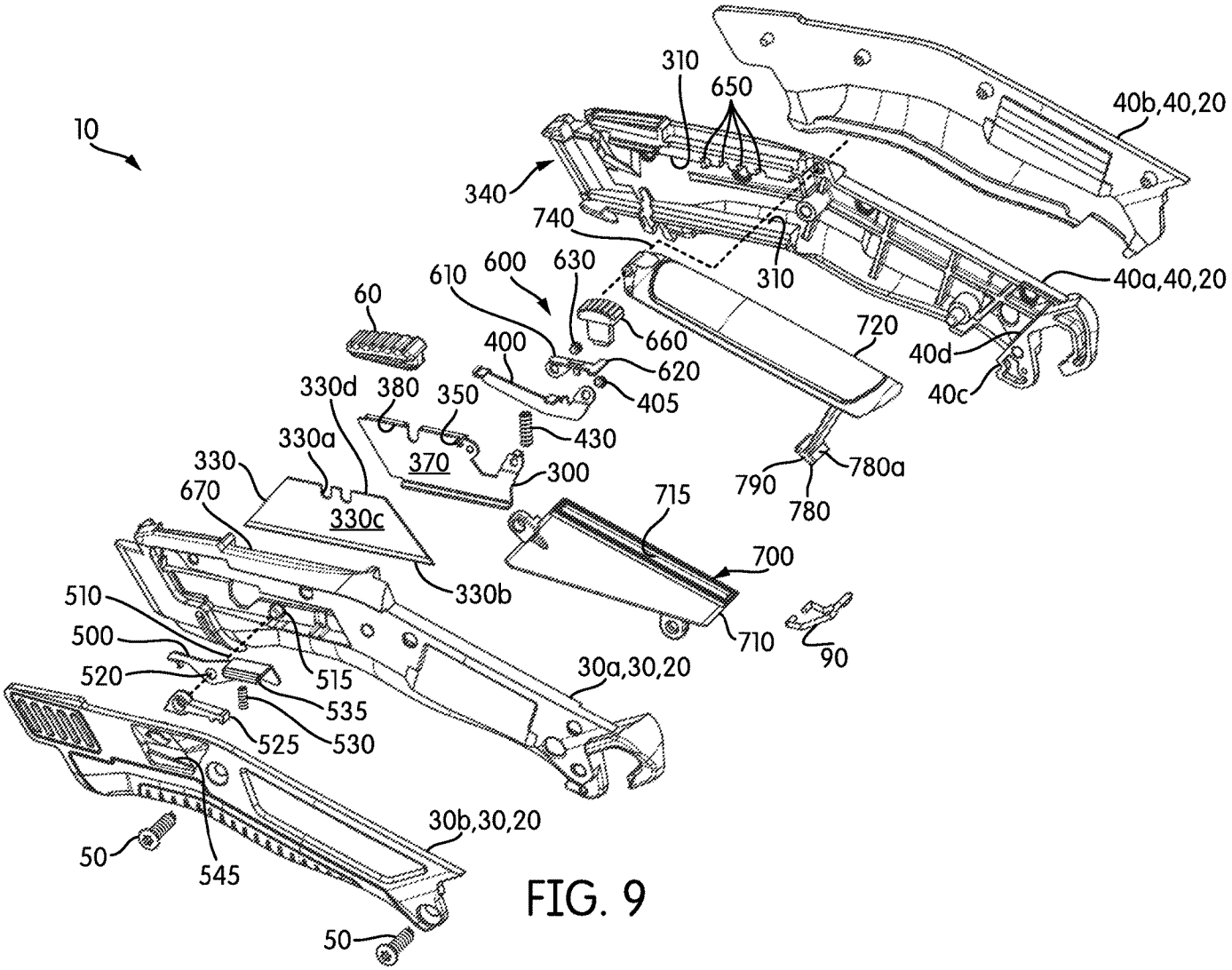
FIG. 9 is an exploded perspective view of the components of the knife of FIG. 1.

As shown in FIG. 9, the handle 20 comprises left and right halves 30, 40, each of which comprises laterally inner parts 30*a*, 40*a*, and laterally outer parts 30*b*,40*b*. The halves 30, 40 are fastened together via bolts 50, or other suitable fasteners (e.g., screws, rivets, glue, welds, etc.). A thumb grip 60 is sandwiched between the halves 30, 40 to provide a grip for the user's thumb (see FIGS. 1, 3). Portions of the handle 20 are also formed by a storage compartment base 710 and storage compartment cover 720.

Figure 3:
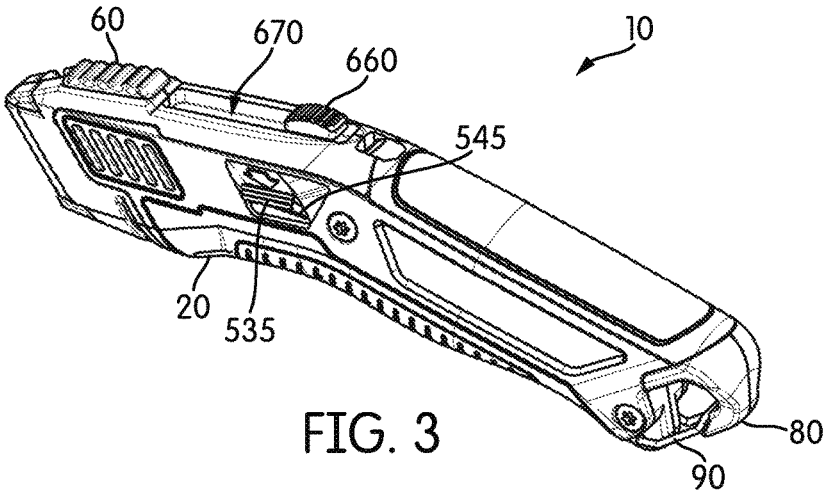
FIG. 3 is a perspective view of the knife of FIG. 1, shown with the blade holder retracted and the blade protected.

As shown in FIGS. 1, 3, and 9, the handle 20 includes a C-shaped retention hook 80, an opening of which is releasably blocked by a spring-loaded lock 90. The hook 80 and lock 90 work like a conventional carabiner to enable a user to selectively attach the knife 10 to a belt loop, ring, rope, hook, or other structure to store the knife 10 when not in use. To detach the knife 10 from such a belt loop or other structure, the user presses on the lock 90 to open up the opening of the C-shape to permit the knife 10 to be removed from the belt loop.

As shown in FIG. 9, the sliding blade holder 300 is slidably/telescopically carried by the handle 20 for movement relative to the handle 20 between a retracted position (see FIGS. 2-3) and one or more extended positions (see FIG. 1). As shown in FIG. 9, the blade holder 300 slides along guide surfaces 310 of the handle halves 30*a*, 40*a* (see FIG. 9) between the extended and retracted positions.

Figure 5:
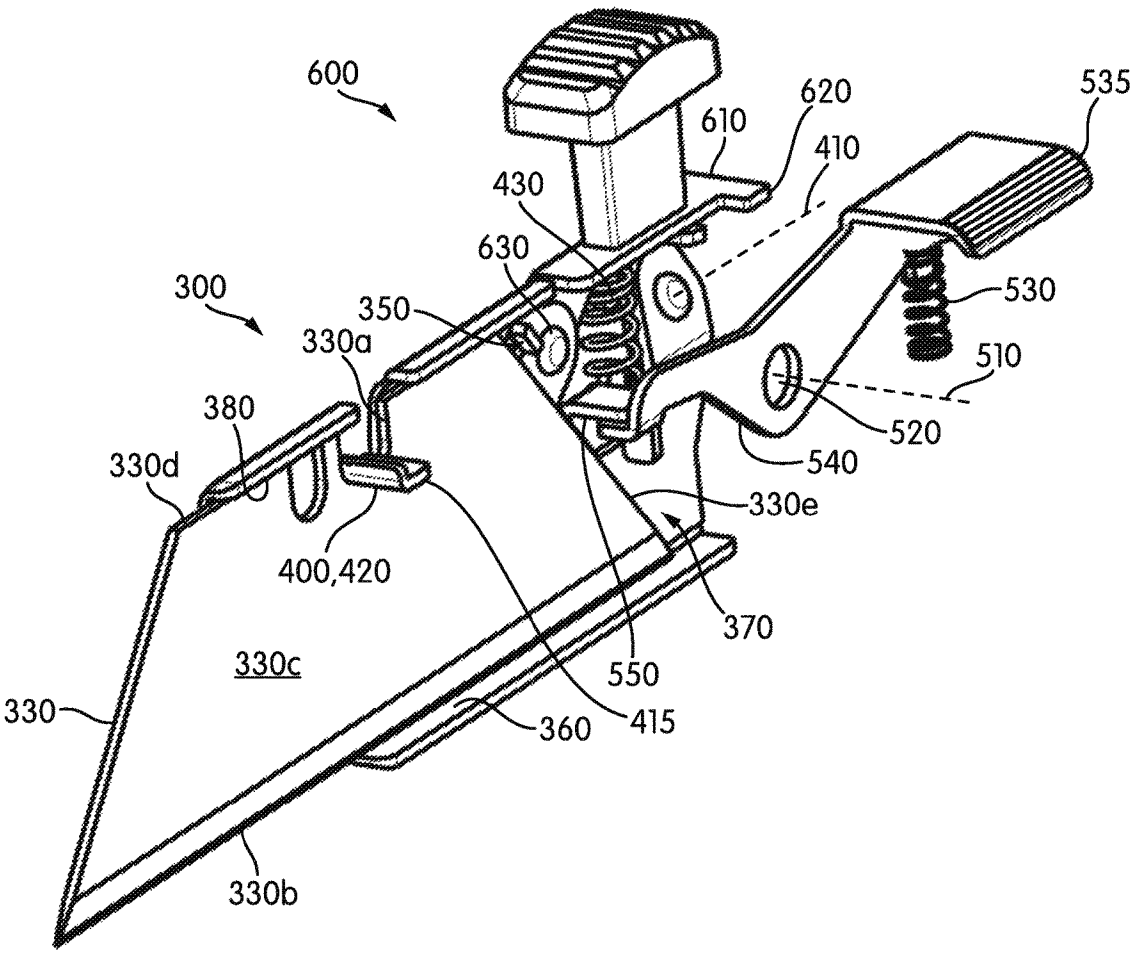
FIG. 5 is a perspective view of the blade holder, blade lock, and blade of the knife of FIG. 1, with the blade lock shown in a locked position and the blade holder shown in the extended position.
Figure 6A:
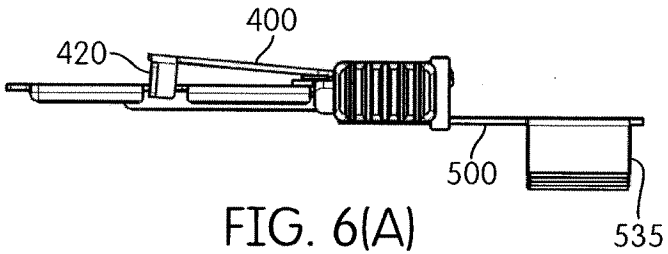
FIGS. 6(A)-(E) are top, right side, front, left side, and bottom views, respectively, of the blade holder and blade lock of the knife of FIG. 1, with the blade lock shown in an unlocked position and the blade holder shown in the extended position.
Figure 6D:
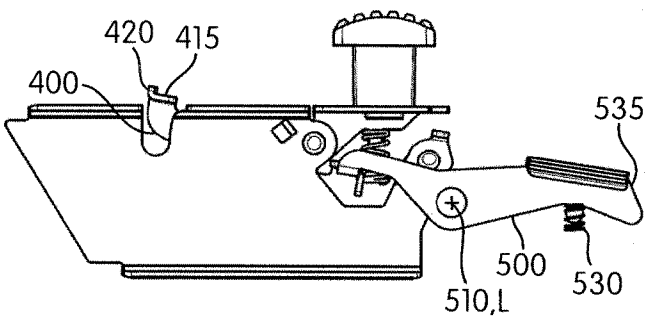
Figure 6E:
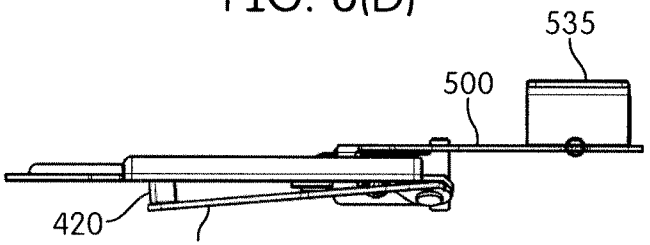
Figure 6C:
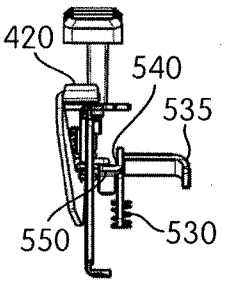
Figure 6B:
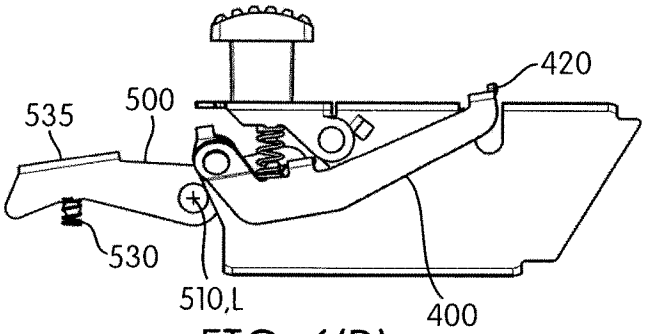

As shown in FIG. 9, the blade holder 300 is configured to receive a utility blade 330. As shown in FIG. 5, the blade 330 has the shape of an isosceles trapezoid and includes a lower, linear cutting edge 330*b*, an upper linear edge 330*d* that is parallel to the lower cutting edge 330*b*, one or more mounting notches 330*a* formed in the upper edge 330*d*, planar side surfaces 330*c*, and linear rear and front surfaces 330*e*. The blade holder 300 is configured to receive the blade 330 by positioning the blade holder 300 it its extended position, and sliding/inserting the blade 330 through a front aperture 340 in the handle 20. As shown in FIG. 5, a rearward blade engaging surface 350 of the blade holder 300 limits the extent to which the blade 330 may be slid rearwardly relative to the blade holder 300. A lower blade engaging surface 360 of the blade holder 300 is planar and is configured to engage the linear cutting edge 330*b* of the blade 330 to limit the extent to which the blade 330 may move downwardly relative to the blade holder 300. As shown in FIGS. 5 and 9, the planar side surfaces 330*c* of the blade 330 are sandwiched between a right blade engaging surface 370 of the blade holder 300 and a surface of the handle half 30*a* to limit the extent to which the blade 330 may move laterally relative to the blade holder 300. An upper blade engaging surface 380 of the blade holder 300 is planar and is configured to engage the upper linear edge 330*d* of the blade 330 to limit the extent to which the blade 330 may move upwardly relative to the blade holder 300.

Figure 4A:
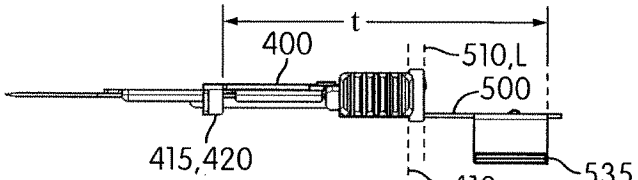
FIGS. 4(A)-(F) are top, right side, front, left side, rear, and bottom views, respectively, of the blade holder, blade lock, and blade of the knife of FIG. 1, with the blade lock shown in a locked position and the blade holder shown in the extended position.
Figure 4D:
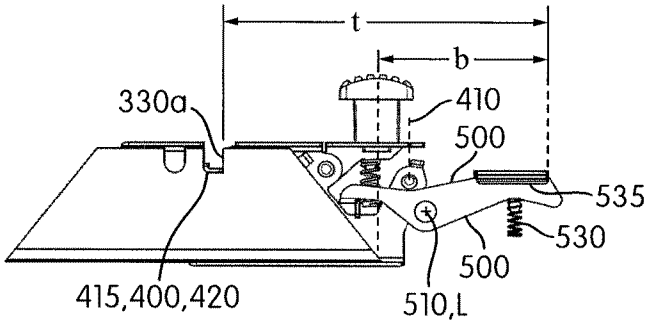
Figure 4F:
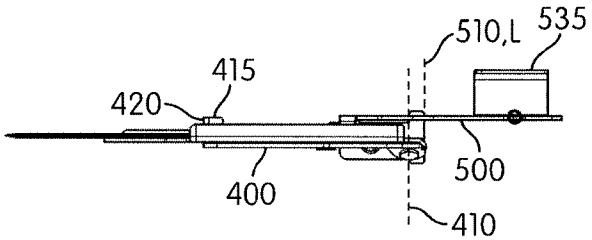

As shown in FIGS. 5-7 and 9, the blade lock or lever 400 is pivotally mounted to a main body of the blade lock 300 for pivotal movement about a blade lock axis 410 between a locked position (shown in FIGS. 4-5) and a released position (shown in FIG. 6). In the illustrated embodiment, the pivotal connection is formed by a bolt or rivet 405 (see FIG. 9) that extends through a hole in the lock 400 to form a hinge. As shown in FIGS. 4B, 5, and 9, a spring 430 operatively extends between the blade lock 400 and another portion of or structure mounted to the blade holder 300 so as to spring-bias the blade lock toward its locked position.

As illustrated in FIG. 5, the blade lock 400 includes a laterally protecting detent 415 with a lock surface 420 that is configured to engage the notch 330*a* of the blade 330 when the blade lock 400 is in the locked position to lock the blade 330 to the blade holder 300. Conversely, when the blade lock 400 is in the released position shown in FIG. 6, the lock surface 420 is moved upwardly away from the notch 330*a* (and preferably above the surface 380) so as not to engage the notch 330*a*. When the blade lock 400 is in the released position, the blade 330 may be freely inserted/slid into and out of the blade holder 330 via the aperture 340 in the front of the handle 20 (see FIGS. 1, 9) to enable the removal/replacement of the blade 330 with a fresh blade or to enable the blade 330 to be flipped 180 degrees about a vertical axis and reinserted so that a fresh end of the cutting edge 330*b* may be used.

A lateral direction L of the blade holder 300 and knife 10 is a side-to-side direction of the knife 10 and extends perpendicularly into and out of the page as shown in FIGS. 1, 2, 4(B), 4(D), 6(B), and 6(D). According to various embodiments, the lateral direction L is perpendicular to (1) the side surfaces 330*c* of the blade 330, (2) the surface 370 of the blade holder 300, (3) the edges 330*b*, 330*d* of the blade 330, (4) a plane that includes both edges 330*b*, 330*d*, and/or (5) a direction of movement of the blade holder 300 between its extended and retracted positions. According to various embodiments, the direction L is parallel to the axes 510 and/or 740.

Figure 4C:
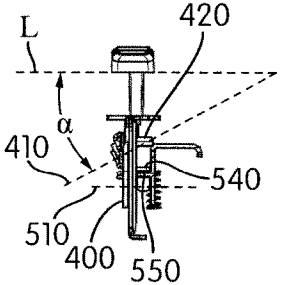
Figure 4B:
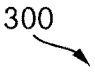
Figure 4B:
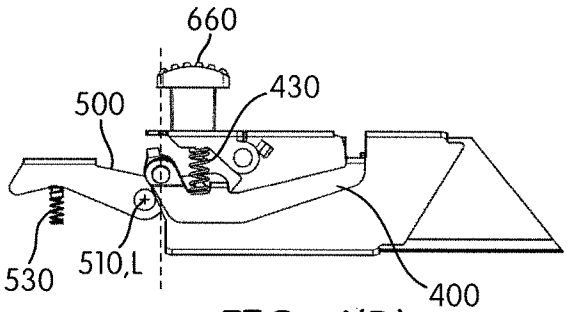
Figure 4E:
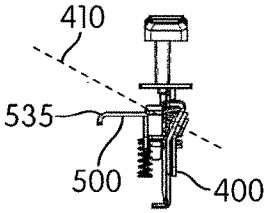

As shown in FIG. 4(C), the blade lock axis 410 forms an angle $\alpha$ with the lateral direction L of the blade holder 400 and knife 10. According to various embodiments, the angle $\alpha$ is (1) greater than 3, 4, 5, 6, 7, 8, 9, 10, 12.5, 15, 17.5, 20, 22.5, 25, 27.5, and/or 30 degrees, (2) less than 87, 85, 80, 75, 70, 65, 60, 55, 50, 45, 40, and/or 35 degrees, and/or (3) within any range between any two such values (e.g., between 3 and 87 degrees, between 5 and 85 degrees, between 10 and 60 degrees, between 15 and 50 degrees, between 20 and 40 degrees, and/or about 30 degrees).

However, according to alternative embodiments, the angle α may be 0 degrees and/or 90 degrees without deviating from the scope of the present invention.

According to various embodiments, the axis 410 is perpendicular to (1) a longitudinal direction of the blade holder 400 and knife 10, (2) the linear edges 330*b*, 330*d* of the blade 330, and (3) the direction of movement of the blade holder 300 between its extended and retracted positions. However, according to various embodiments, the axis 410 may form any other angle (e.g., an acute, obtuse, or 0 degree angle) with such directions without deviating from the scope of the present invention.

According to various embodiments, the blade lock 400 may be moved into its released position by the motion of a blade 330 being inserted into the blade holder 300. In particular, as shown in FIG. 5, if the blade lock 400 is in the locked position (as shown), insertion of a blade 330 through the aperture 340 and into the blade holder 300 (e.g., along the longitudinal direction of the blade holder 330 (from lower left to upper right as shown in FIG. 5)) causes the slanted rearward edge 330*e* of the blade 330 to move the surface 420 upwardly against the bias of the spring 430 toward the lock 400's released position. The surface 420 rides along the rear edge 330*e* and then the upper edge 330*d* of the blade 330, which moves the blade lock 400 toward the released position. When the blade 330 moves into its engaged/received/inserted position, the notch 330*a* longitudinally aligns with the surface 420 and detent 415 so that the lock 400 automatically moves into its locking position under the force of the spring 430.

Because the axis 410 is offset from the lateral direction L by the angle α, pivotal movement of the blade lock 410 from its locked position to its released position moves the surface 420 and detent 415 upwardly and laterally. As shown by a comparison of the locked position in FIGS. 4(B)&(D) and the released position in FIGS. 6(B)&(D), the upward component of this motion enables insertion of the blade 330 to drive the blade lock 330 upwardly as the detent 415 and surface 420 ride up the rearward edge 330*e* of the blade 330 being inserted (see FIG. 5). As shown by a comparison of the locked position top view in FIG. 4(A) and the released position top view in FIG. 6(A), the resulting movement of the blade lock 400 from the locked position to the released position causes the surface 420 and detent 415 to move laterally to the right. According to various embodiments, this mixed lateral and upward motion reduces wear on the surface 420 because the sliding contact point between the surface 420 and blade 330 gradually shifts to different parts of the surface 420 as the blade lock 400 moves toward the released position when a blade 330 is being pushed into the blade holder 300.

In the illustrated embodiment, the blade lock 400 pivotally connects to the blade holder 300. However, according to alternative embodiments, the movable connection between the blade lock 400 and blade holder 300 may comprise any other type of movable connection (e.g., a sliding connection that includes translational movement but not pivotal movement, a 4-bar linkage, etc.). According to one or more of such embodiments, movement of the blade lock 400 between its lock and released positions moves the detent 415 and surface 420 in both the vertical and lateral directions.

As shown in FIG. 9, the manually actuatable blade lock release 500 (or release lever) is connected to the handle 20 for pivotal movement relative to the handle about a release axis 510 (see FIG. 4) between a unactuated position (shown in FIGS. 1-4) and an actuated position (shown in FIG. 5). As shown in FIG. 9, the pivotal connection is formed by an axle 515 on the handle 20 that fits into a hole 520 in the release 500 to facilitate rotational movement about the axis 510. A spacer 525 also fits over the axle 515 to limit the lateral movement of the release 500 relative to the handle 20. A spring 530 extends between the release 500 and handle 20 to spring-bias the release 500 toward its unactuated position. As shown in FIGS. 1-3, 5, 7, and 9, a manually accessible portion 535 (e.g., trigger 535) of the release 500 extends through an opening 545 in the side of the handle 20.

FIGS. 4-6 are shown with the blade holder 300 in the extended position relative to the handle 20 (although the handle 20, itself, is not shown in FIGS. 4-6). As shown in FIG. 5, when the blade holder 300 is in the extended position, a surface 540 of the release 500 longitudinally aligns with a surface 550 of the blade lock 400. To release the lock 400, a user actuates the release 500 by pushing down or depressing the exposed portion/trigger 535 (see FIGS. 1-3 and 7) against the spring biasing force of the spring 530 to move the release 500 from its unactuated position (shown in FIGS. 4-5) to its actuated position (shown in FIG. 6). As shown in FIG. 6, the downward motion of the portion/trigger 535 pivots the release 500 about the axis 510, which lifts the surface 540 upwardly, thereby pushing the surface 550 of the lock 400 upwardly as well, which causes the lock 400 to pivot about the axis 410 into its released position (shown in FIG. 6). A used blade 330 may then be removed from the blade holder 300 by pulling the blade 330 forwardly out of the aperture 340 while the user keeps the trigger/portion 535 actuated/depressed. The user may also depress the trigger/portion 535 to make it easier to install a new blade 330 (so as to avoid relying on the rearward motion of the new blade 330 to push the lock 400 into its released position). When the user releases the trigger/portion 535, the release 500 returns to its unactuated position under the bias of the spring 530 and the lock 400 returns to its locked position under the bias of the spring 430.

When the blade holder 300 is not in its extended position (or its fully extended position according to various embodiments), the surface 540 of the release 500 and surface 550 of the lock 400 are longitudinally misaligned. In particular, the surface 540 is disposed farther forward than the surface 550. In such a misaligned position, actuation of the trigger/portion 535 does not cause the lock 400 to move into its released position because the surfaces 540, 550 do not engage each other. As a result, the lock 400 can only be released by the trigger/portion 535 when the blade holder 300 is extended (or fully extended). According to various embodiment, this structure prevents the blade 330 from accidentally being disengaged from the knife 10 when the blade holder 300 is in the retracted position (or not in the fully extended position). In an embodiment that includes multiple extended positions, the surfaces 540, 550 may only align in one of the multiple extended positions, so that the blade 330 can only be released when the blade holder 300 is slid into the correct extended position (e.g., the most extended position, or a selected less extended position according to various embodiments) and the trigger/portion 535 is actuated while the blade holder 300 is in that extended position.

As shown in FIGS. 4-6, the long lever arms of the blade lock 400 and release 500 result in the trigger/portion 535 being disposed on the knife 10 well rearwardly from the notch 330 330*a*, detent 415, and surface 420 when the blade holder 300 is in the extended position and the trigger/portion 535 may be used to release the blade 330 from the knife 10. According to various embodiments, this rearward positioning of the trigger/portion 535 facilitates more comfortable actuation and/or easier access to the trigger/portion 535 by a user while the user is holding the knife 10 (e.g., with a right-handed user's thumb).

According to various embodiments, as shown in FIGS. 4(A) and 4(D), when the blade holder 300 is in the extended position such that the release 500 is operable to move the blade lock 500 into its released position, a rearwardmost point of the manually-accessible trigger 535 is disposed rearwardly of the rearwardmost points of the notch 330*a*, detent 415, and/or surface 420 by a distance t. The rearward/forward direction of the blade holder 300 and knife 10 is a direction that is parallel to the cutting edge 330*a* when a trapezoidal blade 330 is mounted to the blade holder 300. The rearward/forward direction is also a direction that is parallel to the surface 360 of the blade holder 300 that is configured to abut the cutting edge 330*a*. The rearward/forward direction according to various embodiments may also be a direction of sliding motion of the blade holder 300 when the blade holder 300 is in the extended direction (if the direction of sliding motion is parallel to the cutting edge 330*a* at that extended position). According to various embodiments, the distance t is (a) at least 1.0, 1.1, 1.2, 1.3, 1.4, 1.5, 1.6, 1.7, 1.8, 1.9, and/or 2.0 inches, (b) less than 5.0, 4.0, 3.5, 3.0, 2.9, 2.8, 2.7, 2.6, 2.5, 2.4, 2.3, and/or 2.2 inches, and/or (c) within any range between any two such values (e.g., between 1.0 and 5.0 inches, between 1.5 and 3.0 inches, between 1.7 and 2.7 inches, and/or about 2.1 inches).

According to various embodiments, the manually accessible trigger 535 has a front/rear length of about 0.5 inches. As a result, according to various embodiments, a forwardmost point of the trigger 535 is disposed rearwardly of the notch 330*a*, detent 415, and/or surface 420 when the blade holder 300 is in the extended position by a distance of distance t minus 0.5 inches.

According to various embodiments, when the blade holder 300 is in the extended position, the rearwardmost portion of the notch 330*a* is disposed about 1.0 inch forwardly of a rearwardmost point of the blade 330 such that the rearwardmost point of the blade 330 is disposed forwardly of the rearwardmost point of the trigger 535 by a distance b (see FIG. 4(D)) that equals the distance t minus 1.0 inches.

According to various embodiments, when the blade holder 300 is in the extended position, a rearwardmost point of any structure that moves with the blade holder 300 relative to the handle 20 when the blade holder moves between the extended and retracted positions is disposed about 1.3 inches rearwardly from the rearwardmost point of the detent 415 such that the rearwardmost point of any structure that moves with the blade holder 300 relative to the handle 20 when the blade holder moves between its extended and retracted positions is disposed forwardly of the rearwardmost point of the trigger 535 by a distance t minus 1.3 inches.

Figure 2:
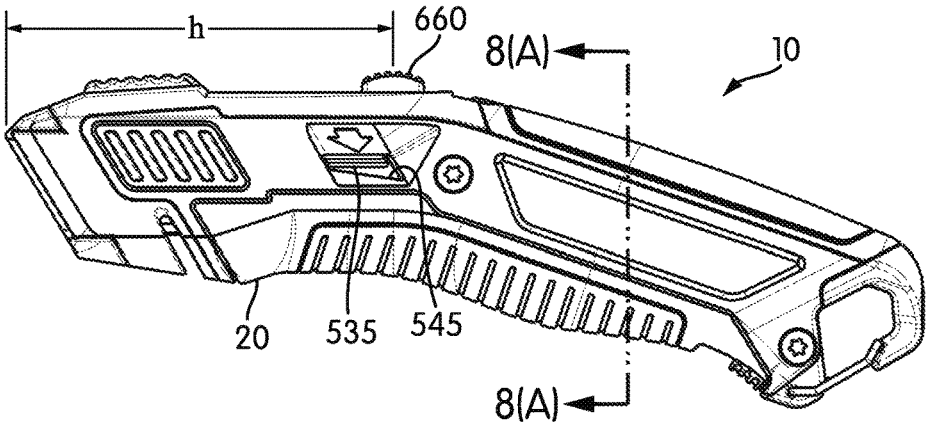
FIG. 2 is a left side view of the knife of FIG. 1, shown with the blade holder retracted and blade protected.

As shown in FIG. 2, a forwardmost point of the handle 20 and/or knife 10 (not including the blade 330) is disposed forwardly of the rearwardmost point of the detent 415 by a distance h. According to various embodiments, the forwardmost point on the handle 20 and knife 10 (not including the blade) is about 0.8 inches forward of the rearwardmost point of the detent 415, surface 420, and notch 330*a* when the blade holder 300 is in the extended position. As a result, the distance h equals distance t plus 0.8 inches. According to various embodiments, the distance h is (a) at least 1.8, 1.9, 2.0, 2.1, 2.2, 2.3, 2.4, 2.5, 2.6, 2.7, and/or 2.8 inches, (b) less than 4.8, 4.3, 3.8, 3.7, 3.6, 3.5, 3.4, 3.3, 3.2, 3.1, and/or 3.0 inches, and/or (c) within any range between any two such values (e.g., between 1.8 and 4.8 inches, between 2.3 and 3.8 inches, between 2.5 and 3.5 inches, and/or about 2.9 inches).

According to various embodiments, the distance h also approximates an absolute distance between the forwardmost point of the handle 20 and a rearwardmost point of the trigger 535.

The knife 10 is configured for right-handed operation with the trigger/portion 535 on the left lateral side of the knife 10 easily accessible by a right hand thumb. A left-handed version of the knife 10 is a mirror image of the illustrated knife 10 such that the trigger/portion 535 protrudes out of a right lateral side of the knife 10 instead.

In the illustrated knife 10, the movable connection between the release 500 and the handle 20 is a pivotal connection. However, according to alternative embodiments, this movable connection may comprise any other type of movable connection without deviating from the scope of the present invention (e.g., a sliding connection, a 4-bar linkage, etc.).

In the illustrated knife 10, the release axis 510 extends purely in the lateral direction L such that the angle $\alpha$ is formed between the release axis 510 and the blade lock axis 410.

When the utility blade 330 is received by the blade holder 300 and the blade lock 400 is in the locked position, movement of the blade holder 300 between its extended and retracted positions moves the utility blade 330 relative to the handle 20 between an exposed position (see FIG. 1) in which the cutting edge 330*b* of the blade 330 is exposed and extends out of the aperture 340, and a protected position (see FIGS. 2-3) in which the blade 330 and its cutting edge 330*b* are protected by the handle 20 and do not extend out of the aperture 340.

In the illustrated embodiment, the blade holder 300 slides/telescopes linearly relative to the handle 20 between its retracted and extended positions. Alternatively, the blade holder 300 may slide/telescope relative to the handle 20 along a simple or complex curved or curvilinear path without deviating from the scope of the present invention.

As shown in FIG. 1, when the blade holder 300 is in its extended position, no portion of the blade holder 300 extends out of the aperture 340 and/or no portion of the blade holder 300 extends forwardly of the handle 20.

As shown in FIG. 9, the knife 10 includes a manually operable slide lock 600 that selectively locks the blade holder 300 in its retracted or one or more extended positions. As shown in FIG. 5, the slide lock 600 comprises a main body 610 with a detent/protrusion 620. The main body 610 pivotally connects to the blade holder 300 so as to be movable between a locked position and an unlocked position. The pivotal connection between the main body 610 and blade holder 300 is formed by a bolt 630 (or rivet or axle or other fastener) that extends through a hole in the main body 610 to form a hinge. While the illustrated movable connection between the blade holder 300 and slide lock main body 610 comprises a pivotal connection, any other type of movable connection may alternatively be used (e.g., a flexible moving connection formed by a leaf spring that extends between the blade holder 300 and main body 610 (e.g., as shown in U.S. Patent Application Publication No. 2010/0223793 A1, the contents of which are hereby incorporated herein by reference)).

The spring 430 extends between the main body 610 and a part of the blade holder 300 or other structure connected to the blade holder 300 (e.g., the lock 400) so as to spring bias the slide lock 600 and main body 610 toward their locked positions. As shown in FIG. 9, the spring 430 biases the detent 620 toward and into one of a plurality of notches 650 in the handle 20. As shown in FIG. 2, when the detent 620 extends into the rearwardmost notch 650, the blade holder 300 is locked in its retracted position. The remaining notches 650 correspond to increasingly extended locked positions, which expose the blade 330 to varying extents.

The slide lock 600 includes an actuator button 660 that extends upwardly from the main body 610 out of handle 20 through a longitudinal slot 670 in the top of the neck 30 (see FIG. 3). To use the slide lock 600 and slide the blade holder 300 between its retracted and extended positions, the user presses the button 660 downwardly to disengage the detent 620 from a notch 650. The user then longitudinally pushes or pulls the button 660 to slide the blade holder 300 into the desired extension/retraction position. The user then releases the button 660, which allows the spring 430 to bias the detent 620 back upwardly into the adjacent notch 650, which locks the blade holder 300 in the selected extension/retraction position. The blade holder 300 is locked by the slide lock 600 in the blade holder 300's retracted position in FIGS. 2-3. The blade holder 300 is locked by the slide lock 600 in an extended position of the blade holder 300 in FIG. 1.

While the illustrated embodiment utilizes a top-mounted button 660 for the slide lock 600, a side-mounted button according to an alternative embodiment of the present invention may be used without deviating from the scope of the present invention. Moreover, any alternative type of slide lock may be used without deviating from the scope of the present invention.

Figure 7:
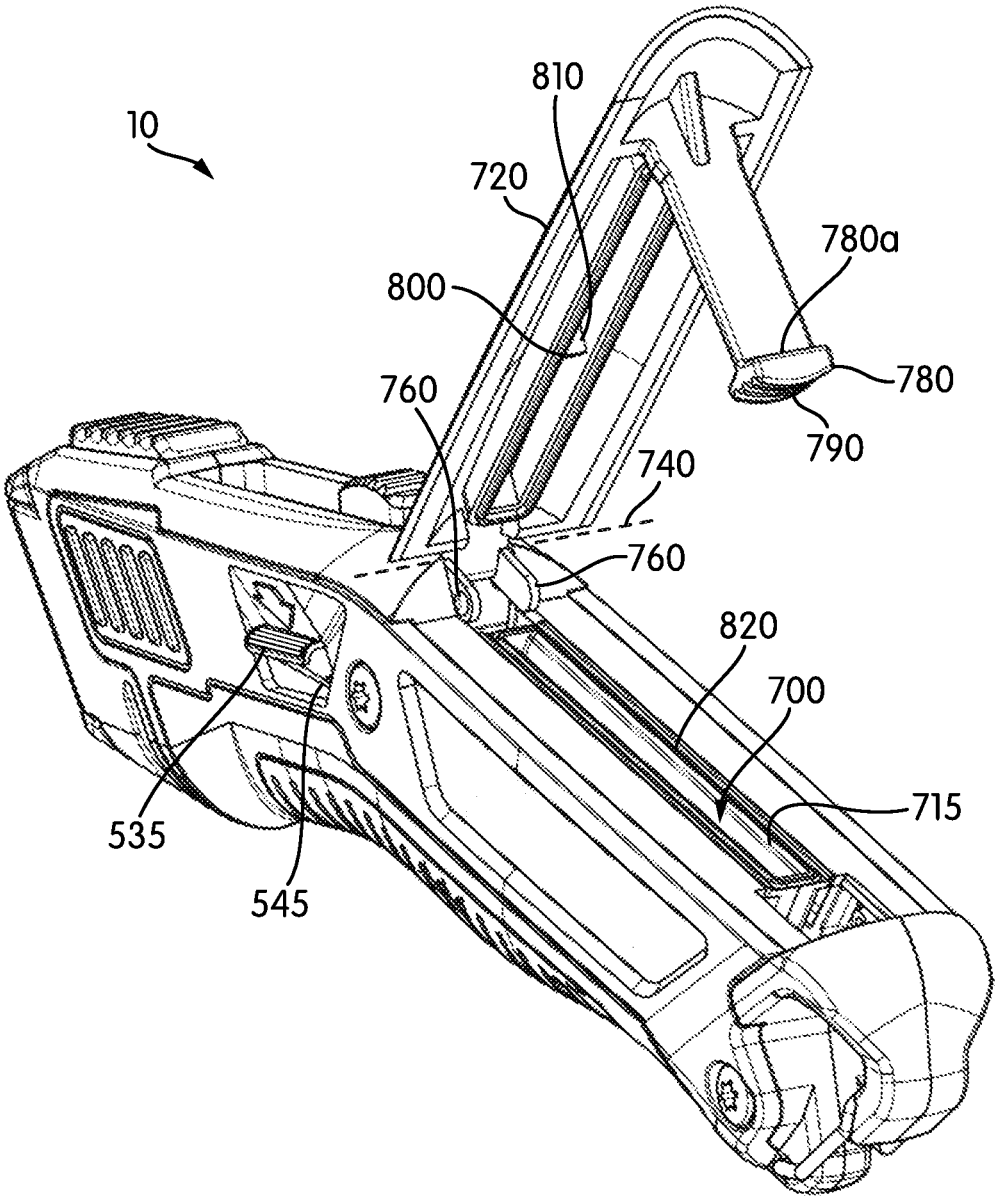
FIG. 7 is a perspective view of the knife of FIG. 1, shown with a storage compartment door open.
Figure 8B:
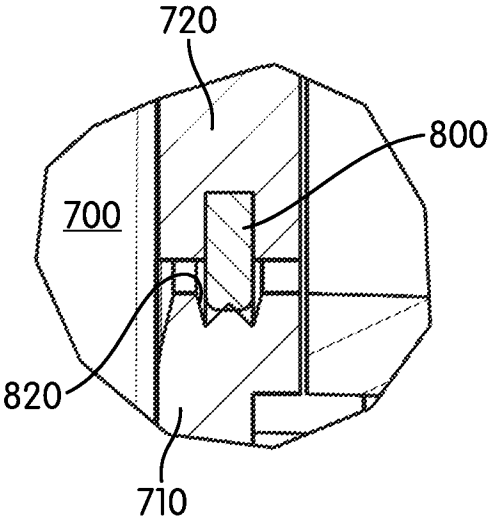
FIG. 8(B) is a detail view of a portion of FIG. 8(A)
Figure 8A:
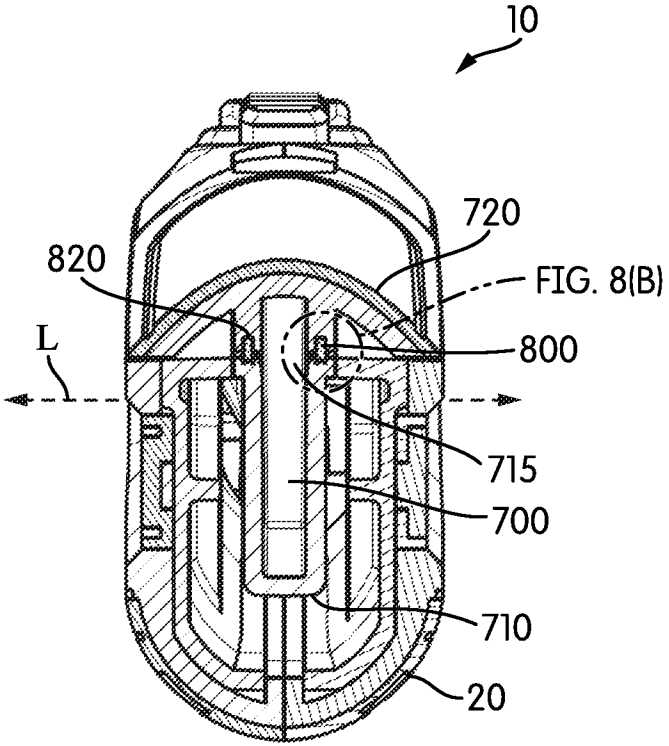
FIG. 8(A) is a cross-sectional view of the knife of FIG. 1, taken along the line 8(A)-8(A) in FIG. 2.

As shown in FIGS. 7-9, the knife 10 includes a storage compartment 700 formed by the storage compartment base 710. The storage compartment base 710 defines a bottom and four sides of the compartment 700, and is accessible through an opening 715 in the top of the compartment 700. As shown in FIG. 9, the base 710 is sandwiched between the handle halves 30*a*, 40*a* and bolted in place by the bolts 50. As shown in FIGS. 7 and 9, the storage compartment cover 720 pivotally connects to the base 710 or other part of the handle 20 for pivotal movement relative to the base 710 and remainder of the handle 20 about a pivot axis 740 between a closed position (shown in FIGS. 1-3 and 8) and an open position (shown in FIG. 7). The cover 720 includes protrusions that fit into holes in the handle halves 30*a*, 40*a* to define a hinge that forms the pivotal connection. According to alternative embodiments, the movable connection between the cover 720 and base 710 may comprise any type of movable connection (e.g., a pivotal connection as shown, a sliding connection, a 4-bar linkage, etc.) without deviating from the scope of the present invention.

As shown in FIG. 7, the cover 720 includes resiliently deformable protrusions 760 that abut a portion of the handle 20 when the cover 720 is moved into its open position and tend to keep the cover 720 in its open position. When a user pushes the cover out of its open position, the user can overcome the small biasing force of the protrusions 760, causing the protrusions to elastically deform laterally inwardly and allow the cover 720 to move into its closed position.

As shown in FIGS. 1, 7, and 9, a cover lock 780 releasably locks the cover 720 in its closed position. As shown in FIG. 9, the cover lock 780 includes a surface 780*a* that abuts a surface 40*c* of the handle 20 to keep the cover 720 closed. The surface 780*a* of the lock is manually movable relative to the handle 20 to disengage the surfaces 780*a*, 40*c* from each other to permit the cover 720 to be moved into its open position. In the illustrated embodiment, the movable connection comprises an elastically deformable portion of the lock 780 that connects the lock 780 to the cover 720. A user releases the cover lock 780 by pushing a manually accessible surface or button 790 forwardly, which moves the surfaces 780*a*, 40*c* out of engagement with each other to permit the user to open the cover 720. To close the cover 720, the user pivots the cover 720 back into its closed position, which causes the lock 780 to ride along a sloped surface 40*d* of the handle 20 (see FIG. 9) until the surface 780*a* spring-biases back into engagement with the surface 40*c* once the cover 720 is closed.

As shown in FIGS. 7-8, the cover 720 includes a seal 800 that forms a closed loop around a perimeter of the opening 715 of the compartment 700 and is sandwiched between the cover 720 and a perimeter of the opening 715 when the cover 720 is closed so as to seal the opening 715 such that the compartment 700 comprises a sealed compartment. The seal 800 may comprise any suitable elastically deformable material (e.g., rubber, plastic). In the illustrated embodiment, the seal 800 is an o-ring seal that is formed into a generally rectangular shape of the perimeter of the opening 715 (see FIG. 7). According to alternative embodiments, the seal 800 may comprise a gasket seal, a piston seal, or any other type of seal. The seal 800 may extend across the entire opening 715 (e.g., a solid sheet of rubber), or have a hole in the middle of the seal 800 (as illustrated).

In the illustrated embodiment, the seal 800 is mounted to the cover 720. However, the seal may alternatively be mounted around a perimeter of the opening 715 (e.g., on the base 710) without deviating from the scope of the present invention. Additionally and/or alternatively, the seal 800 may comprise a two-part seal 800, one part of which is mounted to the cover 720 and another part of which is mounted around the perimeter of the opening 715 (e.g., on the base 710).

The compartment 700 is shaped to store one or more extra blades 330. As illustrated in FIG. 9, the compartment 700 is deeper toward the front than toward the back. As a result, when the cover 720 is open, upper rear edges of the stored blades 330 stick out of the opening 715 so that they may be easily picked up by the user. As shown in FIG. 7, the cover 720 includes an elastically deformable protrusion 810 (e.g., rubber, plastic) that is positioned to engage the stored blades 330 when the cover 720 is closed. The engagement between the protrusion 810 and blades 330 discourages and/or prevents the blades 330 from rattling around in the compartment 700 and making noise when the knife 10 is used or carried.

When the cover 720 is locked closed, the compartment 700 is sealed so as to discourage water and debris from getting into the compartment 700 and rusting or otherwise damaging the blade(s) 330 in the compartment 700. According to various embodiments, closing the cover 720 compresses the seal 800 between the cover 720 and base 710, which slightly elastically deforms the seal 800 to improve its sealing characteristics. As shown in FIGS. 7-8(B), the base 710 includes a groove 820 into which the seal 800 fits when the cover 720 is closed. The groove 820 further improves the sealing characteristics of the seal 800. According to various embodiments, the sealed compartment 700 is airtight, water resistant, and/or watertight.

Figure 10:
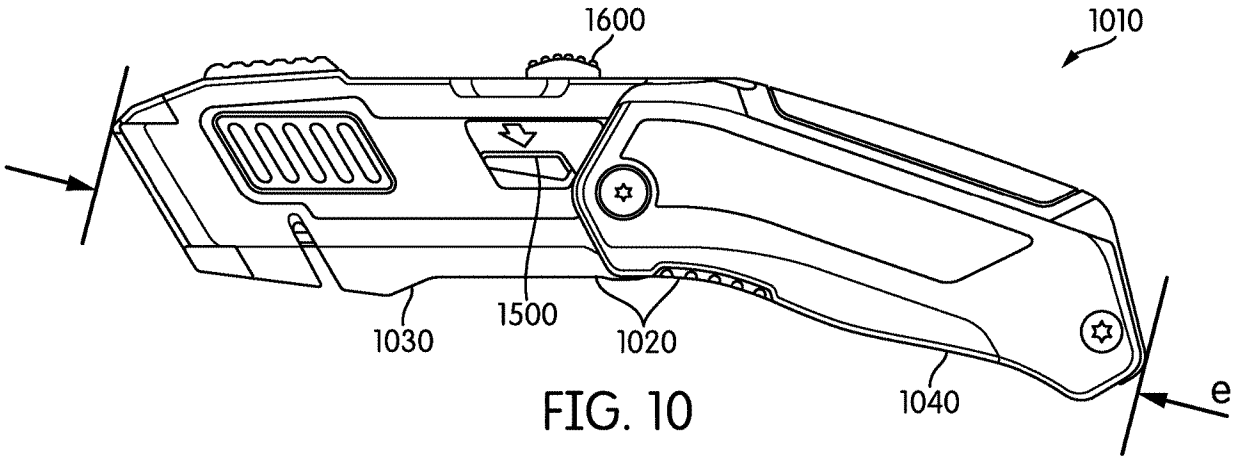
FIG. 10 is a left side view of a knife according to an alternative embodiment, shown with the blade holder in the retracted position and the neck in an open position.
Figure 11:
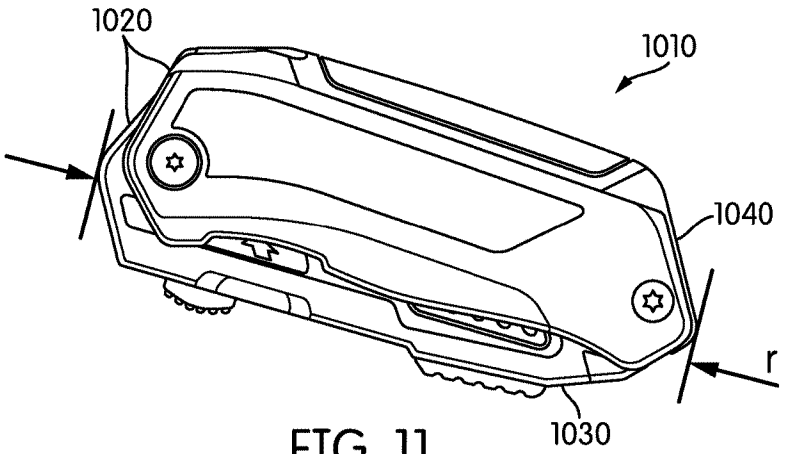
FIG. 11 is a left side view of a knife of FIG. 8, shown with the blade holder in the retracted position and the neck in a closed position.
Figure 12:
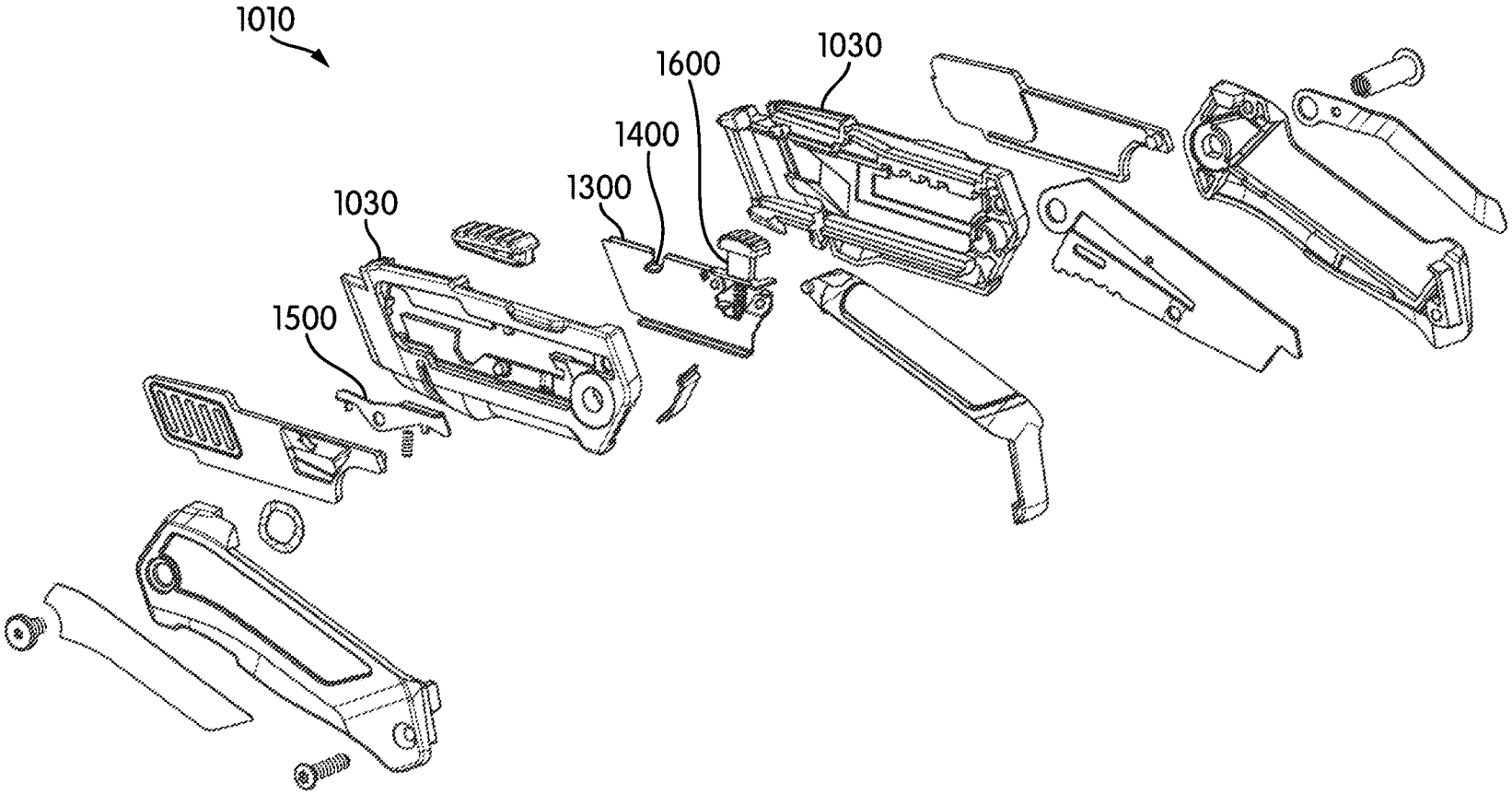
FIG. 12 is an exploded perspective view of the components of the knife of FIG. 10.

FIGS. 10-12 illustrate a knife 1010 that is generally similar to the knife 10, except that the knife 1010 has a folding handle 1020 instead of a fixed handle 20. The folding handle 1020 comprises a neck 1030 and handle base 1040. The neck 1030 is pivotally movable relative to the handle base 1040 between a closed position (shown in FIG. 11) and an open position (shown in FIG. 10). The neck 1030 and handle base 1040 may movably connect to each other and operate in a similar or identical manner as described in U.S. Patent Application Publication No. 2010/0223793 A1 and/or U.S. Provisional Application No. 62/250,730, titled "Spring-Assisted Utility Knife," filed Nov. 4, 2015, the entire contents of both of which are hereby incorporated herein by reference.

According to various embodiments, the knife 1010 includes a manually releasable neck lock that releasably locks the neck 1030 in the closed position. The neck lock is configured such that manually releasing the neck lock while the neck 1030 is in the closed position permits the neck 1030 to be moved into the neck's open position. The neck lock may additionally releasably lock the neck 1030 in the open position. The neck lock may be structured in the manner described in U.S. Patent Application Publication No. 2010/0223793 A1, the neck lock teachings of which are hereby incorporated by reference herein. However, any other suitable type of neck lock may alternatively be used without deviating from the scope of the present invention.

The neck lock and/or any other feature of the knife 1010 may be structured in the manner described in U.S. Provisional Application No. 62/250,730, titled "Spring-Assisted Utility Knife," filed Nov. 4, 2015, the entire contents of which are incorporated herein by reference.

In the illustrated embodiment, the neck 1030 pivotally connects to the handle base 1040. However, according to various alternative embodiments, the neck 1030 is movably connected to the handle base 1040 via any other type of suitable movable connection (e.g., linear or curved telescopic/sliding connection between the handle base 1040 and neck 1030) without deviating from the scope of the present invention. For example, the knife 1010 may be modified so that the neck 1030 is slidable relative to the handle base 1040 between the closed and open positions, for example, as shown in U.S. Pat. No. 7,930,829, the entire contents of which are hereby incorporated by reference.

As shown in FIG. 12, the knife 1010 includes a blade holder 1300, a blade lock 1400, a manually actuatable blade lock release 1500, and a slide lock 1600 that operate relative to the neck 1030 in the same manner that the sliding blade holder 300, blade lock 400, manually actuatable blade lock release 500, and slide lock 600, respectively, operate relative to the handle 20 of the knife 10. Accordingly, a redundant description of these structures and their operation is omitted. The knife 1010 may additionally include any of the features or components of the knife 10 without deviating from the scope of the present invention.

In the embodiment illustrated in FIGS. 10-12, when the neck 1030 is in its open position, the neck 1030 and handle base 1040 generally extend linearly relative to each other to maximize an open length of the handle 1020. However, according to alternative embodiments of the present invention, the neck 1030 and handle base 1040 may define an arc (e.g., "(" shape) or angle (e.g., ">" shape) when the neck 1030 is in its open position.

According to various embodiments, the handle base 1040 includes a surface that prevents the neck 1040 from folding into its closed position (1) if the blade is in an exposed position, (2) unless the blade is in the protected position, (3) if the blade holder 1300 is in an extended position, and/or (4) unless the blade holder 1300 is in the retracted position. According to various embodiments, when the neck 1030 is in the closed position, the surface of the handle base 1040 prevents (1) the blade from moving into an exposed position, (2) the blade from moving out of the protected position, (3) the blade holder 1300 from moving out of the retracted position, and/or (4) the blade holder 1300 from moving into the extended position.

By retracting the blade holder 1300 and protecting the blade 330 before the neck 1030 is pivoted into the closed position, the overall length of the closed knife 1010 (as shown in FIG. 11) can be reduced to make the knife 1010 more compact when not in use. The combined use of a pivotally-folding handle 1020 and a sliding blade holder 1300 may result in a compact, versatile knife. As shown in FIG. 10, an overall extended length e of the knife 1010 is defined as the largest distance between any two points on the knife 1010 (not including any blade) when the neck 1030 is in its open position. As shown in FIG. 11, an overall retracted length r of the knife 1010 is defined when the neck 1030 is in its closed position. The lengths e,r may be along a diagonal (e.g., skewing into the page as shown in FIGS. 10 and 11). According to various embodiments, the length e may be (1) at least 3.5, 4, 4.5, 5, 5.5, 6, 6.5, and/or 7 inches, (2) less than 9, 8.5, 8, 7.5, 7, and/or 6.5 inches, and/or (3) within any range between such upper and lower values (e.g., between 3.5 and 9 inches, between 4 and 7 inches, between 4.5 and 7 inches, and/or about 5.75 or 6.75 inches). According to various embodiments, the length r may be (1) less than 5.5, 5, 4.5, 4.25, 4, 3.75, 3.5, 3.25, and or 3 inches, (2) greater than 1.5, 2, 2.5, 3, 3.5, and/or 4 inches, and/or (3) within any range between any two such values (e.g., between 2.5 and 5.5 inches, between 2.5 and 4.5 inches, about 3 or 4.25 inches).

According to various embodiments, the length e may be (1) at least 15%, 20%, 25%, 30%, 35%, 40%, 45%, 50%, 55%, 60%, 65%, 70%, or 80% larger than the length r, (2) less than 100%, 90%, 80%, 70%, and/or 65% larger than the length r, and/or (3) within any range between any two such values (e.g., length e is between 15% and 100% larger than length r). In one embodiment, the length e is about 61% larger than the length r. Accordingly, moving the neck 1030 into its open position makes the handle 1020 substantially longer, which may make the handle 1020 more comfortable for a user by providing a longitudinally longer support surface for the user's hand when using the knife 1010. Conversely, moving the neck 1030 into its closed position makes the handle 1020 substantially smaller, making the knife 1010 easy to store/carry.

Figure 13:
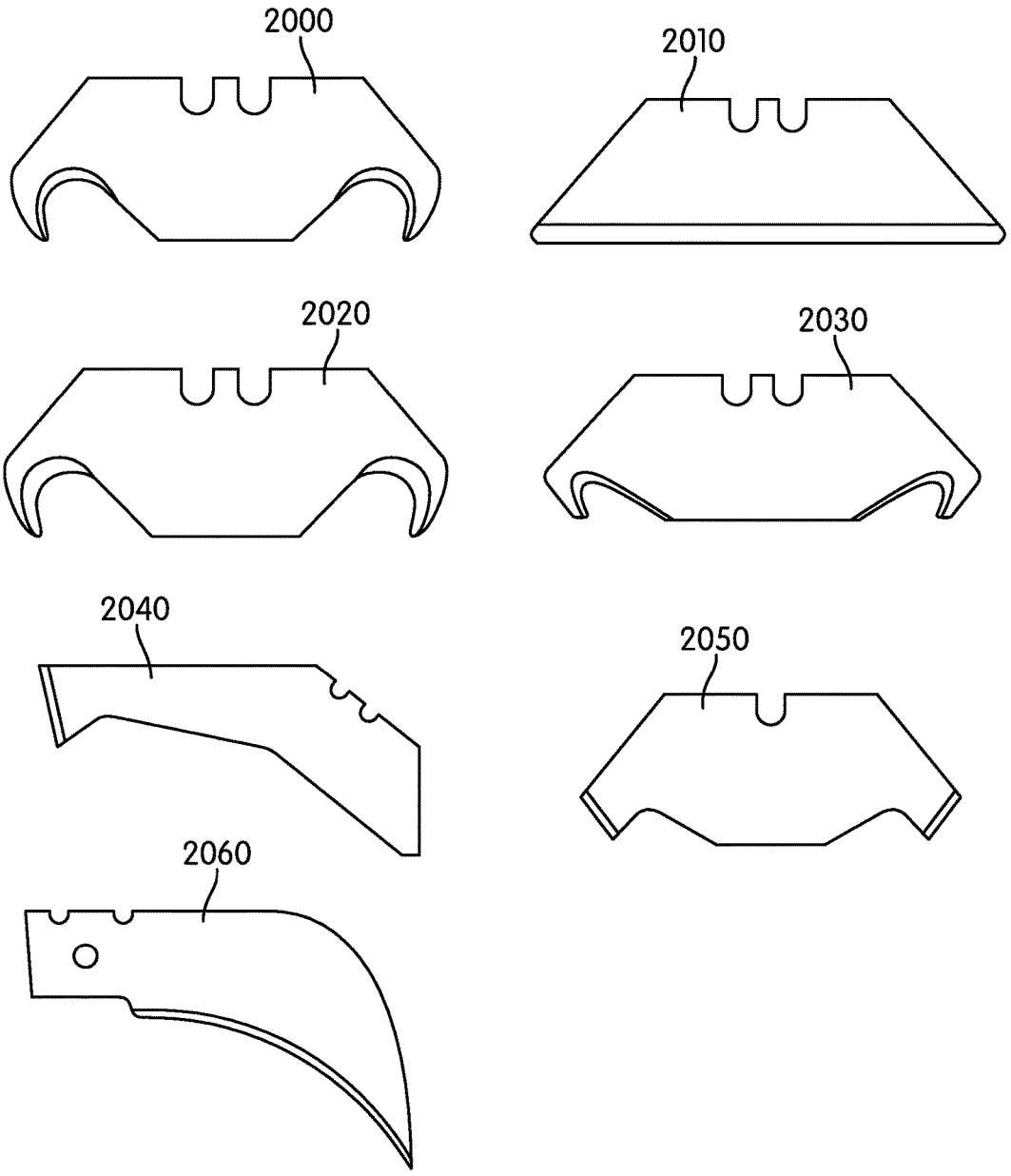
FIG. 13 includes side views of various utility blades that may be used with the knives according to various embodiments.

While the illustrated blade 330 comprises a trapezoidal utility blade, a variety of other utility blades may be used with the knives 10, 1010 without deviating from the scope of the present invention. According to one or more embodiments of the present invention, the blade may comprise a blade having parallel upper and lower edges, at least one notch in the upper edge, and a cutting edge. The blade may be the trapezoidal blade 330 illustrated, or any other type of utility blade having structure that can be locked to the blade holder 300, 1300 and knife 10, 1010 in a manner similar to that described above with respect to the blade 330. FIG. 13 illustrates various examples of utility blades 2000, 2010, 2020, 2030, 2040, 2050, 2060 that may be used in connection with the knives 10, 1010 without deviating from the scope of the present invention. The use of the blades 2040, 2060 may prevent the blade holder 300, 1300 from moving into its fully retracted position and may prevent the handle 1020 from fully closing according to various embodiments. However, the neck 1030 and handle base 1040 may be sized to as to accommodate such blades in the fully retracted blade holder position and the closed handle 1020 position. The illustrated standard trapezoidal blades 330, 2010 are about 2⅜ inches long and about ¾ of an inch high.

The components of the handle 20, 1020, neck 1030 and handle base 1040 may comprise any suitable materials (e.g., metal, plastic, rubber), and be manufactured using any suitable techniques (e.g., metal stamping, casting, molding, etc.). The outer surfaces of the handle 20, 1020 may be provided with a textured and/or elastic surface (e.g., rubberized) to facilitate a user's secure and comfortable grip of the handle 20, 1020.

The knives 10, 1010 include various springs 430, 530. Such springs may comprise any suitable type of spring (e.g., coil spring, torsion spring, elastic band, etc.) that is configured to elastically bias the component in the stated direction.

The knives 10, 1010 include a variety of pivotal connections. While the illustrated embodiments use particular types pivotal connections, any other type of pivotal connections may alternatively be used without deviating from the scope of the present invention (e.g., living hinges, conventional hinges, axle/bushing pivotal connections, etc.).

The foregoing illustrated embodiments are provided to illustrate the structural and functional principles of the present invention and are not intended to be limiting. To the contrary, the principles of the present invention are intended to encompass any and all changes, alterations and/or substitutions within the spirit of the invention.

What is claimed is:

1. A knife comprising:

a handle;

a blade holder connected to the handle and configured to receive a utility blade; and a blade lock pivotally connected to the blade holder for movement relative to the blade holder about a blade lock axis between a locked position and a released position, wherein, when the blade lock is in the locked position, a lock surface of the blade lock is configured to engage the utility blade to lock the blade to the blade holder, wherein the lock surface moves in the lateral direction of the knife and in an upward direction of the knife as the blade lock moves from its locked position to its released position, wherein, when the blade lock is in the released position, the lock surface is configured to permit the utility blade to be inserted into and removed from the blade holder, wherein the blade lock axis forms an angle ($\alpha$) relative to a lateral direction of the knife, and wherein the angle ($\alpha$) is between 5 and 85 degrees.

2. The knife of claim 1, wherein the angle ($\alpha$) is between 15 and 50 degrees.

3. The knife of claim 1, wherein the angle ($\alpha$) is between 20 and 40 degrees.

4. The knife of claim 1, further comprising a spring that spring-biases the blade lock toward its locked position.

5. The knife of claim 1, further comprising:

a manually actuatable blade lock release that is movably connected to the handle for movement between an unactuated position and an actuated position; and a blade lock release spring that spring-biases the blade lock release toward its unactuated position, wherein the blade lock release is configured to be positioned relative to the blade lock such that movement of the blade lock release from its unactuated position to its actuated position forces the blade lock to move into the blade lock's released position, and wherein the release comprises a manually accessible trigger portion that can be manually actuated by a user to move the release from the unactuated position into the actuated position.

6. The knife of claim 5, wherein the blade lock release comprises a lever that is pivotally connected to the handle for pivotal movement about a release axis relative to the handle between the unactuated and actuated positions.

7. The knife of claim 6, wherein the release axis extends purely in the lateral direction such that the angle ($\alpha$) is formed between the release axis and the blade lock axis.

8. The knife of claim 5, wherein a rearwardmost point of the trigger portion is disposed rearwardly of a forwardmost point on the handle by a distance (h), wherein the distance (h) is at least 1.8 inches and less than 5.0 inches.

9. The knife of claim 5, wherein:

the blade holder is movably carried by the handle for movement relative to the handle between a retracted position and an extended position, when the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively, when the blade holder is in the extended position, movement of the blade lock release from its unactuated position to its actuated position forces the blade lock to move into the blade lock's released position, and when the blade holder is in the retracted position, movement of the blade lock release from its unactuated position to its actuated position does not force the blade lock to move into the blade lock's released position.

10. The knife of claim 1, wherein:

the blade holder is slidingly carried by the handle for sliding movement relative to the handle between a retracted position and an extended position, and when the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively.

11. The knife of claim 10, further comprising a manually operable slide lock that releasably locks the blade holder in the extended position or the retracted position.

12. The knife of claim 1, wherein the lock surface moves in the lateral direction of the knife as the blade lock moves from its locked position to its released position.

13. The knife of claim 1, further comprising the utility blade, wherein the utility blade is received by the blade holder.

14. The knife of claim 1, wherein the blade holder comprises a side surface that is configured to abut a planar side surface of the utility blade, wherein the side surface of the blade holder is perpendicular to the lateral direction.

15. The knife of claim 1, wherein:

the knife further comprises a manually actuatable blade lock release that is movably connected to the handle for movement between an unactuated position and an actuated position, the blade holder is movably carried by the handle for movement relative to the handle between a retracted position and an extended position, the manually actuatable blade lock release is movable between its unactuated position and its actuated position while the blade holder is in its retracted position, when the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively, when the blade holder is in the extended position, movement of the blade lock release from its unactuated position to its actuated position forces the blade lock to move into the blade lock's released position, and when the blade holder is in the retracted position, movement of the blade lock release from its unactuated position to its actuated position does not force the blade lock to move into the blade lock's released position.

16. A knife comprising:

a handle;

a blade holder connected to the handle and configured to receive a utility blade;

a blade lock movably connected to the blade holder for movement relative to the blade holder between a locked position and a released position, wherein, when the blade lock is in the locked position, a lock surface of the blade lock is configured to engage the utility blade to lock the blade to the blade holder, and wherein, when the blade lock is in the released position, the lock surface is configured to permit the utility blade to be inserted into and removed from the blade holder; and a manually actuatable blade lock release that is movably connected to the handle for movement between an unactuated position and an actuated position, wherein the blade lock release is configured to be positioned relative to the blade lock such that movement of the blade lock release from its unactuated position to its actuated position forces the blade lock to move into the blade lock's released position, and wherein the blade lock release comprises a manually accessible trigger portion that can be manually actuated by a user to move the release from the unactuated position into the actuated position, and wherein the blade lock release comprises a lever that is pivotally connected to the handle for pivotal movement between the actuated and unactuated positions, and wherein the knife further comprises a spring that spring biases the blade lock release toward its unactuated position.

17. The knife of claim 16, further comprising the utility blade, wherein the utility blade is locked to the blade holder by the blade lock, wherein a rearwardmost point of the utility blade is disposed forwardly of a rearwardmost point on the trigger portion by a distance (b), wherein the distance (b) is at least 0.8 inches and less than 4.2 inches.

18. The knife of claim 16, further comprising the utility blade, wherein the utility blade is received by the blade holder.

19. The knife of claim 16, wherein:

the blade holder is movably carried by the handle for movement relative to the handle between a retracted position and an extended position, the manually actuatable blade lock release is movable between its unactuated position and its actuated position while the blade holder is in its retracted position, when the utility blade is received by the blade holder and the blade lock is in the locked position, movement of the blade holder between its extended and retracted positions moves the utility blade relative to the handle between an exposed position in which a cutting edge of the blade is exposed, and a protected position in which the cutting edge of the blade is protected by the handle, respectively, when the blade holder is in the extended position, movement of the blade lock release from its unactuated position to its actuated position forces the blade lock to move into the blade lock's released position, and when the blade holder is in the retracted position, movement of the blade lock release from its unactuated position to its actuated position does not force the blade lock to move into the blade lock's released position.

20. The knife of claim 16, wherein a rearwardmost point of the trigger portion is disposed rearwardly of a forwardmost point on the handle by a distance (h), wherein the distance (h) is at least 1.8 inches and less than 5.0 inches.

21. The knife of claim 16, wherein the blade holder is movably carried by the handle for movement relative to the handle, the blade lock release, and the lever between a retracted position and an extended position.

22. A knife comprising:

a handle;

a blade holder connected to the handle and configured to receive a utility blade; and a blade lock pivotally connected to the blade holder for movement relative to the blade holder about a blade lock axis between a locked position and a released position, wherein, when the blade lock is in the locked position, a lock surface of the blade lock is configured to engage the utility blade to lock the blade to the blade holder, wherein the lock surface moves in the lateral direction of the knife and in an upward direction of the knife as the blade lock moves from its locked position to its released position, wherein, when the blade lock is in the released position, the lock surface is configured to permit the utility blade to be inserted into and removed from the blade holder, wherein the blade lock axis forms angle ($\alpha$) relative to a lateral direction of the knife, and wherein the angle ($\alpha$) is between 5 and 85 degrees, wherein the knife further comprises a manually actuatable blade lock release that is movably connected to the handle for movement between an unactuated position and an actuated position, the blade lock release being configured to be positioned relative to the blade lock such that movement of the blade lock release from its unactuated position to its actuated position forces the blade lock to move into the blade lock's released position, and wherein the blade holder is movably carried by the handle for movement relative to the handle and the blade lock release between a retracted position and an extended position.

* * * * *